US005146196A

United States Patent [19]

Frank

[11] Patent Number: 5,146,196

[45] Date of Patent: Sep. 8, 1992

[54] ANTI-RATTLE FEATURE FOR SOLENOID

[75] Inventor: James C. Frank, Mesa, Ariz.

[73] Assignee: General Motors Corporation, Detroit, Mich.

[21] Appl. No.: 692,428

[22] Filed: Apr. 29, 1991

[51] Int. Cl.[5] ..... H01F 7/08; H01F 3/00; H01F 1/00

[52] U.S. Cl. ..... 335/271; 335/257; 335/261; 335/262; 335/270; 335/277; 335/279

[58] Field of Search ..... 335/247, 248, 249, 255, 335/257, 261, 263, 262, 271, 277; 290/38 R, 38 A-38 E, 48; 251/129.15, 129.21

[56] References Cited

U.S. PATENT DOCUMENTS

| | | | |
|---|---|---|---|
| 2,619,116 | 11/1952 | Ralston | 137/561 |
| 2,735,047 | 2/1956 | Garner | 335/257 |
| 2,830,743 | 4/1958 | Rimsha | 251/129.21 |
| 3,226,605 | 12/1968 | Wright et al. | 317/178 |
| 3,415,487 | 12/1968 | Robarge | 251/129.21 |
| 3,426,304 | 2/1969 | Cannon et al. | 335/255 |
| 4,177,440 | 12/1979 | Merlette | 335/247 |
| 4,217,567 | 8/1980 | Roy et al. | 335/262 |
| 4,262,877 | 4/1981 | Lang | 335/262 |
| 4,278,959 | 7/1981 | Nishimiya et al. | 335/262 |
| 4,477,789 | 10/1984 | Karlow | 335/257 |
| 4,619,536 | 10/1986 | Takemoto | 400/157.2 |
| 4,745,386 | 5/1988 | Pawiak | 335/258 |
| 4,845,451 | 7/1989 | Uetsuhara et al. | 335/257 |

*Primary Examiner*—Gerald P. Tolin
*Assistant Examiner*—Ramon M. Barrea
*Attorney, Agent, or Firm*—Charles E. Leahy

[57] ABSTRACT

A solenoid has a coil energizable to displace an armature in one direction and a spring urging return of the armature in the other direction to a rest position in which an end of the armature engages a stop. The end of the armature has a conical projection machined thereon which projects from the end thereof. The stop is a resilient grommet having conical bore therein so that the rest position of the armature is defined by the spring urging the armature to the rest position with the conical projection of the armature resting in the conical bore of the stop to thereby provide noise-free and rattle-free positioning of the armature at the rest position.

3 Claims, 1 Drawing Sheet

ANTI-RATTLE FEATURE FOR SOLENOID

The invention relates to an electrical solenoid and more particularly provides a resilient stop having a conical bore therein receiving a conical projection on the armature to define a rattle-free rest position of the armature.

DESCRIPTION OF THE PREFERRED EMBODIMENT

It is well known to provide an electrical solenoid in which a cylindrical armature is slidably mounted within a plastic bobbin which carries an electrical coil. Electrical energization of the coil causes the armature to be moved in one direction through the bobbin. A spring acts on the armature to urge return of the armature in the other direction when the coil is deenergized. The spring urges the armature to a rest position defined by the engagement of the armature with a stop carried by the solenoid housing.

The aforedescribed solenoid requires an air gap between the armature and the bobbin in order to permit the axial movement of the armature within the sleeve. However, this air gap defines a space in which the armature rattles, particularly if the solenoid is used in a motor vehicle. In addition, the return of the armature to the rest position by the spring causes a noise when the armature engages the stop. It would be desirable to provide a new and improved anti-rattle stop for a solenoid.

SUMMARY OF THE INVENTION

According to the present invention, a solenoid has a coil energizable to displace an armature in one direction and a spring urging return of the armature in the other direction to a rest position in which an end of the armature engages a stop. The end of the armature has a conical projection machined thereon which projects from the end thereof. The stop is a resilient grommet having conical bore therein so that the rest position of the armature is defined by the spring urging the armature to the rest position with the conical projection of the armature resting in the conical bore of the stop to thereby provide noise-free and rattle-free positioning of the armature at the rest position.

These and other objects, features, and advantages of the invention will become apparent upon consideration of the description of the preferred embodiment and the appended drawings in which.

DESCRIPTION OF THE PREFERRED EMBODIMENT

Figure 1:
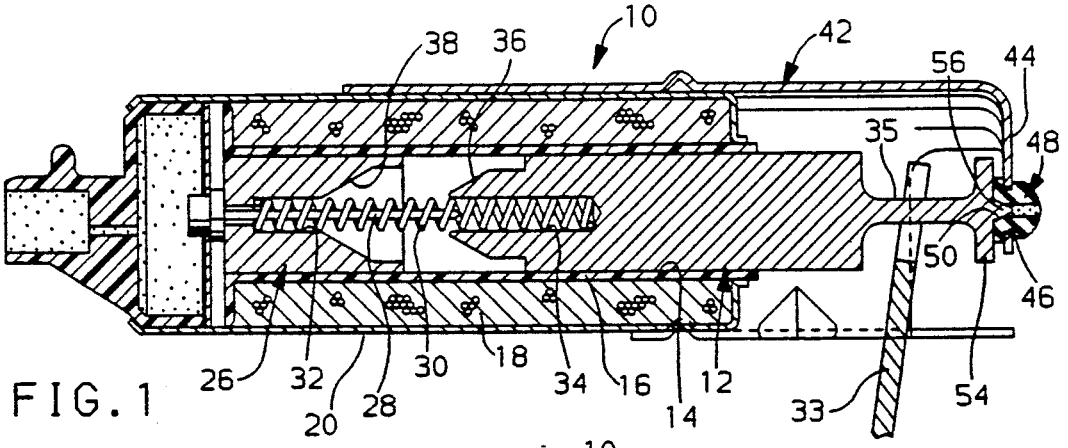
FIG. 1 is an elevation view through the solenoid showing the armature established at the rest position.

Referring to FIG. 1, an electrical solenoid 10 includes a cylindrical armature 12 machined from an electromagnetic material and slidably mounted within a bore 14 of a plastic bobbin 16. An electric coil 18 is wound around the bobbin 16. A cylindrical housing 20 surrounds the coil 18, bobbin 16 and armature 12. As best seen in FIG. 1, the left-hand end of the bore 14 of bobbin 16 has an end piece 26 mounted therein. The end piece carries a spring guide pin 28 encircled by a coil compression spring 30. One end of the spring 30 is seated in a spring seat 32 of the end piece 26 and the other end of the spring 30 is seated in a spring seat 34 of the armature 12. Accordingly, as seen in FIG. 1, the coil compression spring 30 urges rightward movement of the armature 12 to a rest position. The solenoid is used to operate a device such as a latch, not shown, therefore a forked lever, indicated at 33 extends into engagement with a necked down portion 35 of the armature 12.

Figure 2:
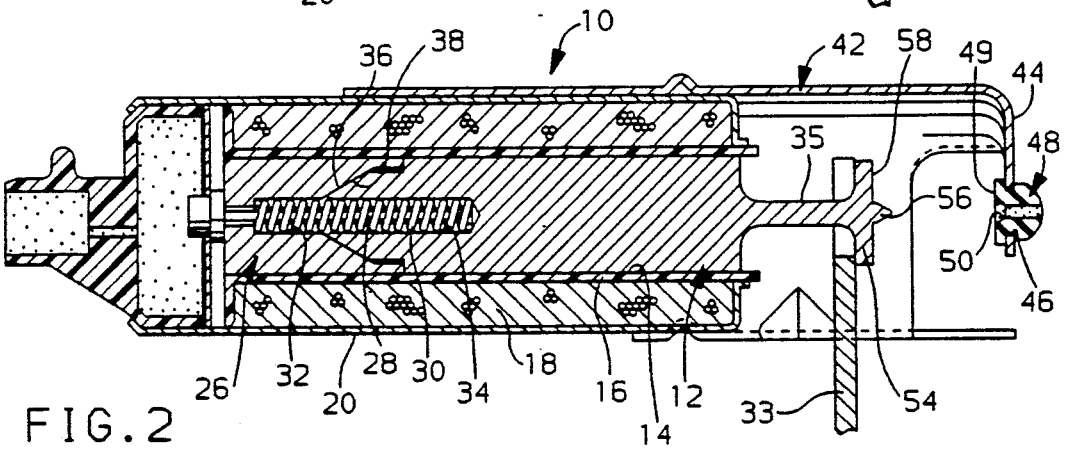
FIG. 2 is a view similar to FIG. 1 but showing the armature moved leftwardly by the energization of the coil.

As best seen in FIG. 2, energization of the coil 18 induces electromagnetic force which retracts the armature 12 leftwardly to the position of FIG. 2 in which the forked lever 33 is operated by the armature. As best seen in FIG. 2, the leftward movement of the armature 12 is limited by the engagement of the armature 12 with the end piece 26. The left-hand end of the armature 12 carries a tapered end 36 which seats within a tapered recess 38 of the end piece.

Figure 3:
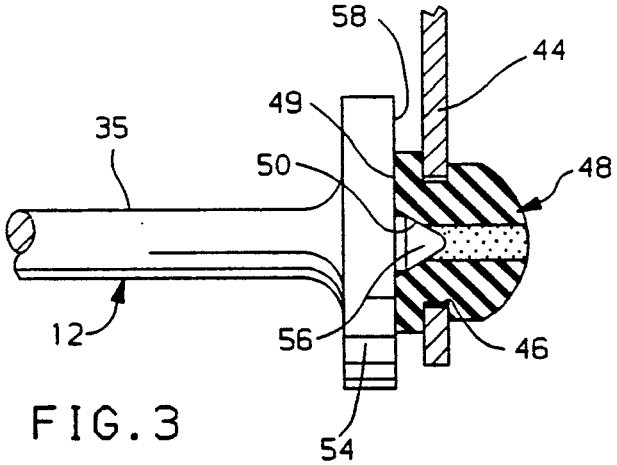
FIG. 3 is an enlarged fragmentary view showing the conical on the end of the armature and the co the stop.

When the coil 18 is deenergized, the electromagnetic force ceases and the spring 30 returns the armature 12 rightwardly. As seen in FIGS. 1 and 2 a stop bracket 42 is suitably attached to the housing 20 and has an arm 44 which projects into the path of the armature 12. The bent arm 44 has a aperture 46 in which a resilient grommet 48 is seated. As best seen in FIG. 3, the resilient grommet 48 has an end face 49 with a conical bore 50 therein and the end 54 of the armature 12 carries a conical shaped projection 56 which projects from an end face 58 of the armature.

As seen in FIGS. 2 and 3, the rest position of the armature 12 is defined by the spring 30 urging the rightward movement of the armature 12 to the position of FIG. 3 in which the end face 58 of the armature 12 engages the end face 49 of the grommet 48, and the conical projection 56 is seated in the conical bore 50. The compression spring 30 maintains a constant bias force on the armature 12 to maintain the armature 12 in engagement with the grommet 48.

Referring again to FIG. 1 it will be appreciated that the engagement between the conical projection 56 of the armature 12 and the conical bore 50 of the grommet 48 will be effective to restrain the armature 12 against rattling up and down as the vehicle traverses the roadway. In particular, the interaction between the conical projection and the conical bore guides the armature to a centered position and the resilience of the grommet provides noise free engagement therebetween.

Figure 4:
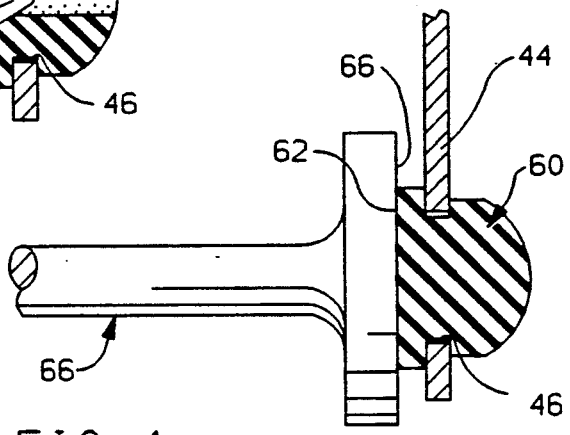
FIG. 4 PRIOR ART
FIG. 4 shows the prior art armature stop.

FIG. 4 shows a prior art construction in which an armature stop is provided by a rubber grommet 60 with a flat face 62 which is engaged by a flat face 64 of an armature 66.

Thus it is seen that the invention provides a new and improved stop mechanism for a solenoid armature which is particularly suited to provide noise free stopping of the armature when the armature is returned to the rest position by a biasing spring. Furthermore the spring loaded engagement of the conical projection within the conical bore is effective to prevent the armature from rattling in the vehicle.

The embodiments of the invention in which an exclusive property or privilege is claimed are defined as follows:

1. In a solenoid having a coil energizeable to displace an armature in one direction and a spring urging return of the armature in the other direction to a rest position in which an end of the armature engages a fixedly mounted stop stop, the improvement comprising:

said stop being a resilient stop fixedly mounted in the solenoid engageable by the end of the armature to define a fixed rest position;

and one of said resilient stop and said armature having a conical projection projecting from the end thereof and the other having a conical bore therein so that the rest position of the armature is defined by the spring urging a conical seating relationship between the conical projection and the conical bore to restrain the armature against rattling in the coil.

2. In a solenoid having a coil energizeable to displace an armature in one direction and a spring urging return of the armature in the other direction upon de-energization of the coil to a rest position in which an end of the armature engages a stop, the improvement comprising:

said end of the armature having a conical projection projecting from the end thereof; and said stop being a resilient grommet having a conical bore therein so that the rest position of the armature is defined by the spring urging seating of the conical projection in the conical bore to restrain the armature against rattling in the coil.

3. In a solenoid having a coil energizeable to displace an armature in one direction and a spring urging return of the armature in the other direction upon de-energization of the coil to a rest position in which an end of the armature engages a stop, the improvement comprising:

said end of the armature having an end face and a conical projection projecting from the end thereof; and said stop being a resilient grommet having a an end face facing the end face of the armature and a conical bore provided in the end face of the grommet so that the rest position of the armature is defined by the spring urging the end face of the armature into engagement with the end face of the grommet and seating of the conical projection in the conical bore to restrain the armature against rattling in the coil.

* * * * *